United States Patent [19]

Affüpper

[11] Patent Number: 4,941,241

[45] Date of Patent: Jul. 17, 1990

[54] WARP MACHINE

[75] Inventor: Hans Affüpper, Wuppertal, Fed. Rep. of Germany

[73] Assignee: Hans Affüpper Textilmaschinenbau GmbH, Fed. Rep. of Germany

[21] Appl. No.: 255,025

[22] Filed: Oct. 7, 1988

[30] Foreign Application Priority Data

Oct. 7, 1987 [DE] Fed. Rep. of Germany ..... 3733918

[51] Int. Cl.[5] ..... D02H 13/00; D02H 3/00

[52] U.S. Cl. ..... 28/196; 28/197

[58] Field of Search ..... 28/196, 197

[56] References Cited

U.S. PATENT DOCUMENTS 320,466 6/1885 Dickinson ..... 28/196
4,850,086 7/1989 Schewe ..... 28/196

FOREIGN PATENT DOCUMENTS 15683 of 1885 United Kingdom ..... 28/196
28322 of 1909 United Kingdom ..... 28/196

*Primary Examiner*—Werner H. Schroeder
*Assistant Examiner*—Bradley Kurtz DeSandro
*Attorney, Agent, or Firm*—Wigman & Cohen

[57] ABSTRACT

The invention relates to a warp machine for warping and spooling warp threads, particularly elastic or viscous warp threads. The warp machine according to the present invention includes a warp beam or parallel warp beam for taking up the warp thread and which is mounted to be rotationally driven about a rotary axis and which consists of a cylindrical spool element preferably having two lateral, flange-like warp beam discs. In addition, the machine is equipped with a compression element which is preferably movably mounted in an essentially radial direction to the warp beam which engages between the warp beam discs, and which presses the warp thread against the spool element. According to the present invention, the compression element is formed in two parts from two compression rollers, each of which is mounted only in the area of a frontal side so as to rotate about rotary axes that lie parallel to each other and to the rotary axis of the warp beam in such a manner that the free front side of each compression roller extends toward one of the warp beam discs, and the two compression rollers overlap in an axially central area of the warp beam by an axial length X greater than zero. In this configuration the compression element can have smaller diameter and low gyration mass.

20 Claims, 3 Drawing Sheets

WARP MACHINE

TECHNICAL FIELD

The present invention relates to a warp machine for warping and spooling warp threads, particularly elastic or viscous warp threads, and more particularly to a warp machine having a warp beam or partial warp beam which takes up the warp thread and is mounted so as to be driven in rotation about a rotary axis. It includes a cylindrical spool element with two lateral, flange-like warp beam discs, and has a compression element which is mounted so as to be able to move essentially radially relative to the warp beam, engages between the warp beam discs and presses the warp threads against the spool element.

BACKGROUND OF THE INVENTION

In known warp machines of this type, the compression element, which is necessary particularly in the warping of elastic or viscous warp threads, consists of a compression cylinder which is rotatably mounted on a pivotable holder and is of an axial length so as to approximately coincide (except for a small amount—about 2–3 mm of axial play) with the inner axial spacing of the warp beam discs from each other. Because the width of the compression cylinder must engage between the warp beam discs and come to rest against the spool element, it has a relatively large diameter, especially because its rotary axis must lie outside the radius of the warp beam discs. In other words, the compression cylinder must have a radius that at least equals the radius of the warp beam discs minus the radius of the spool element. However, this large diameter also leads to certain disadvantages, for example, even with the use of a hollow cylinder, when handling a large mass or gyrating mass whereby the operating speed of the machine is severely limited by the resulting unacceptably high centrifugal forces, it is necessary to brake the compression cylinder. Additionally, the large compression cylinder requires a large amount of space even when it is retracted from the warp beam, which alone results in the warp machine having disadvantageously large dimensions. Further, it is disadvantageous that each given warp beam length or width requires a specific associated compression cylinder, which because of the large dimensions of the compression cylinder, leads to expensive storage arrangements and greater expense in work and time in conversion work when a warp beam is changed.

A solution for reducing the diameter of the compression cylinder has long been sought. It is known, for example, to hinge the compression cylinder to at least one mounting arm which engages with one truncated end between the warp beam discs. In such a system, the truncated end portion of the mounting arm is arranged within a depression formed in the front side of the compression cylinder. This makes it possible to place the rotary axis of the compression cylinder in the area lying between the warp beam discs, so that the diameter of the compression cylinder can be somewhat reduced. Such a measure immediately faces a limitation however, because the truncated end portion of the mounting arm must in any case be located within the depression in the compression cylinder, i.e., the diameter of the depression can not be smaller than the length of the truncated end portion of the mounting arm.

SUMMARY OF THE INVENTION

It is an object of the present invention in a warp machine of the type described above to reduce the dimensions of the compression element and thereby of the warp machine itself, and with regard to the compression element, to lower the costs for storage and machine conversion operations.

According to the present invention, this is achieved by forming the compression element in two parts from two compression rollers, which are preferably mounted at one side so as to rotate about axes that are parallel to each other and also to the rotary axis of the warp beam in such a manner that the free frontal side of each compression roller extends toward one of the warp beam discs. The two compression rollers overlap in an axially central portion of the warp beam by an axial length greater than zero. With this advantageous embodiment it is possible to form the compression rollers with a diameter that can be greatly reduced and which also have a very low mass. The low mass, in addition to the small diameter, also leads advantageously to very low gyrating masses during rotation. High operating speeds are therefore possible for the warp machine according to the present invention, without having to brake the compression rollers. The compression rollers are thus significantly reduced in their dimensions; they also require comparatively little space when positioned removed from the warp beam, so that the overall dimensions of the warp machine according to the present invention can also be reduced. Storage and machine conversion result in reduced costs.

In a particularly advantageous further development of the invention, at least one of the compression rollers is guided so as to be axially adjustable independent of the other compression roller. When one warp beam is changed for another having a different axial length or width, this especially advantageous measure makes it unnecessary to change the compression elements (i.e., the compression rollers) in their entirety since the axial distance of the free frontal sides of the two compression rollers from each other can be varied by a relative shifting of the two rollers toward each other and they can thereby be precisely adapted to the inside dimension between the warp beam discs. Costs for storage of different compression elements thereby are completely eliminated, and in a conversion of the machine the changing of the compression element is also eliminated. This measure therefore contributes in an especially advantageous manner to the solution of the above object.

Additional advantageous characteristics of the preferred embodiment of the present invention are contained in the following detailed description and the dependent claims.

BRIEF DESCRIPTION OF THE DRAWINGS

An exemplary embodiment of the invention is described in greater detail and illustrated in the drawing figures below in which.

DETAILED DESCRIPTION OF THE PREFERRED EMBODIMENTS

Figure 1:
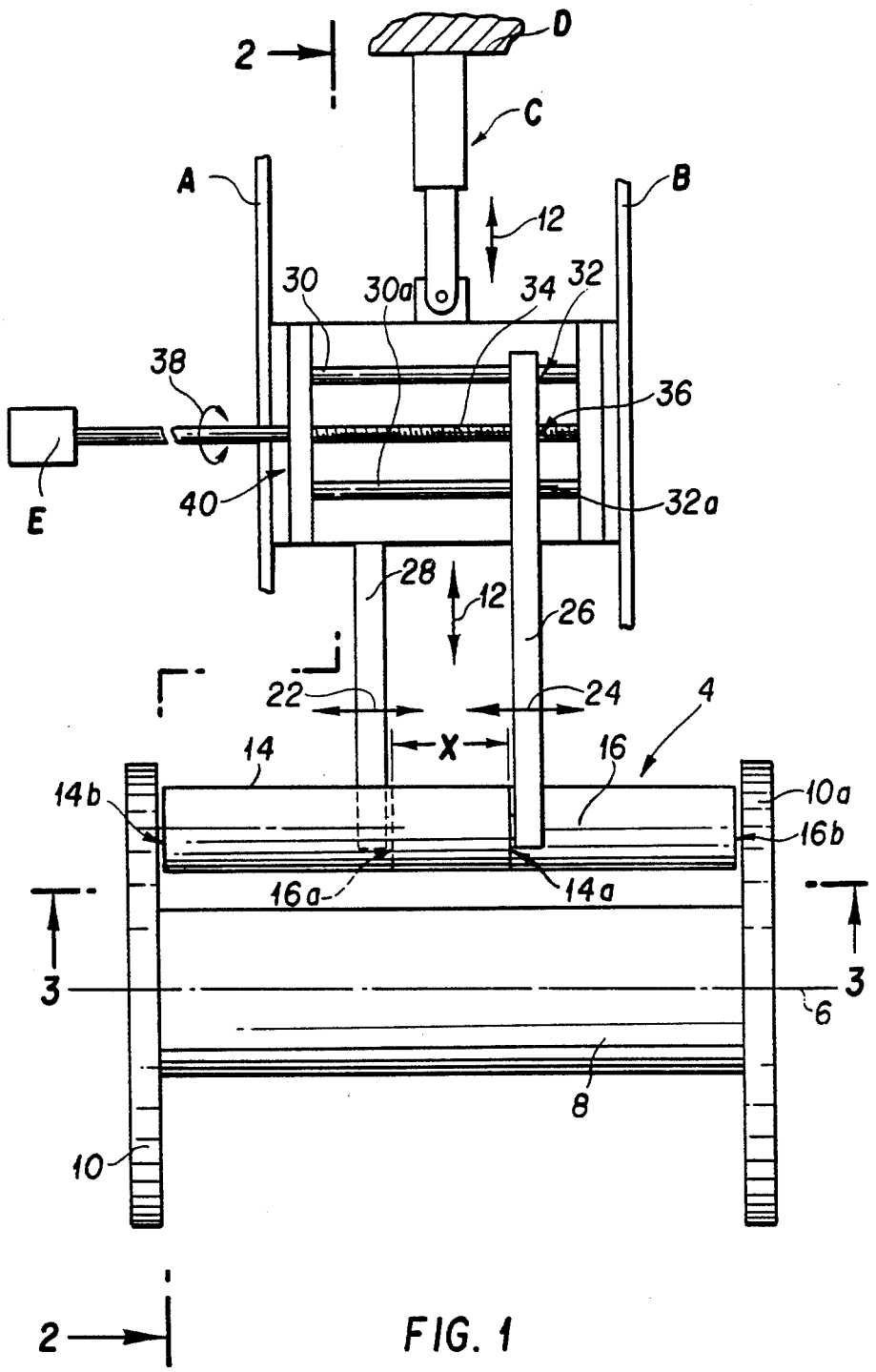
FIG. 1 is a top view of a portion of a warp machine according to the present invention.
Figure 2:
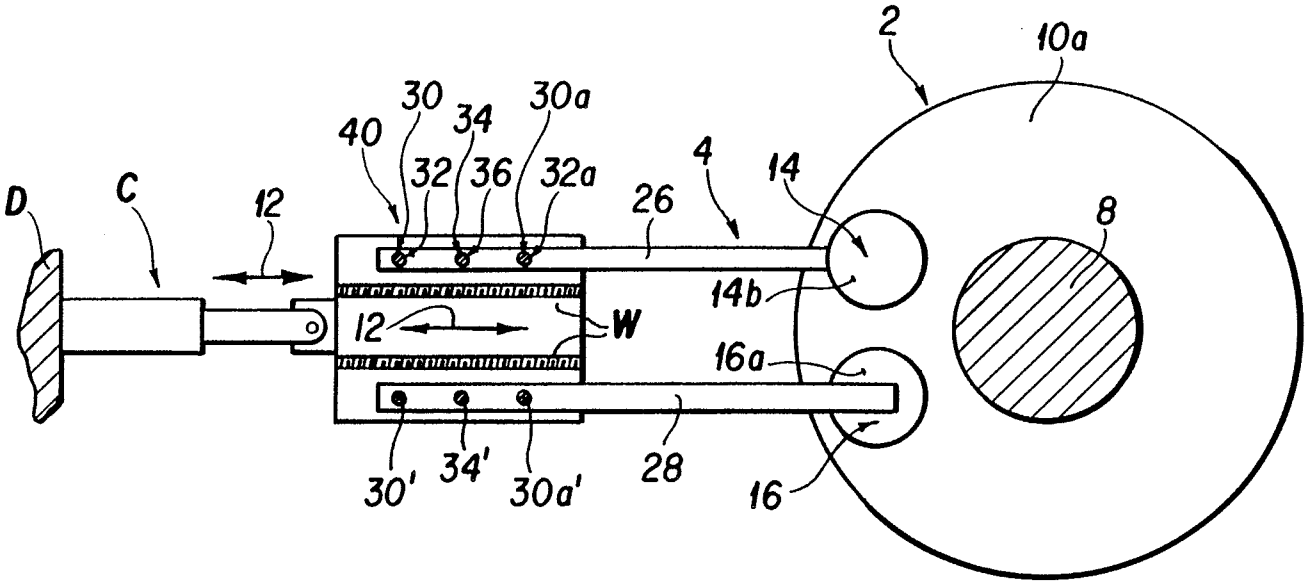
FIG. 2 is a section view along the section line 2—2 in FIG. 1.
Figure 3:
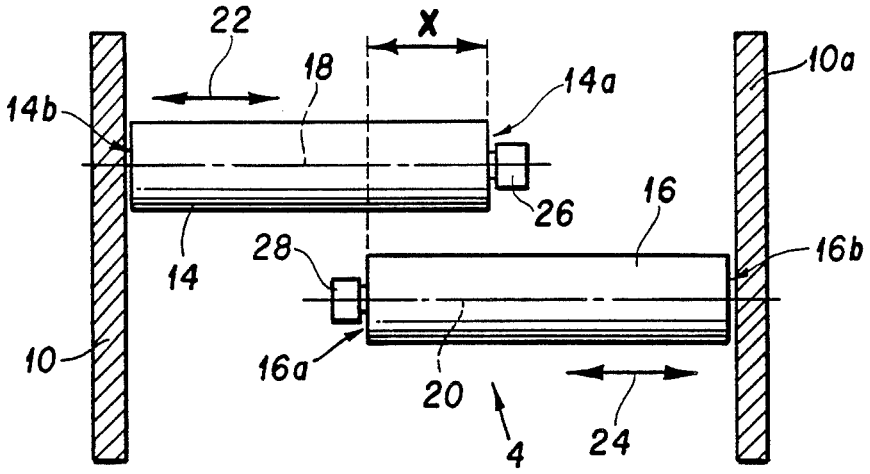
FIG. 3 is a section view along the line 3—3 in FIG. 1.

Shown in FIGS. 1–3 are a compression element and only one warp beam or partial warp beam 2 of a warp machine according to the present invention, on which warp thread (not shown) is wound on spools in a parallel fashion. Certain other elements of the warp machine are not objects of the present claimed invention and are therefore not discussed in great detail below.

Warp beam 2 is mounted by conventional mounting means (not shown) so as to be capable of being driven in rotation about a rotary axis 6 (FIG. 1). Warp beam 2 consists of a cylindrical spool element 8 having two lateral flange-like warp beam discs 10 (outside flanges) which can be connected with the spool element 8 either rigidly or so as to be capable of axial movement.

Compression element 4 is mounted so as to be movable in a direction that is essentially radial to warp beam 2 as indicated by double-direction arrow 12 and engages between the warp beam discs 10, in order to press the warp threads against the spool element 8, which is necessary particularly with elastic or viscous warp threads, and which is also effective with other warp thread materials.

According to the invention, compression element 4 is formed in two parts from two compression rollers 14, 16. Each compression roller 14, 16 is mounted only in an area of one frontal side **14*a*, 16*a* so as to rotate about a rotary axis 18, 20. The rotary axes 18, 20 of the two compression rollers 14, 16 are thereby arranged parallel to each other and also to the rotary axis 6 of warp beam 2. The rotary mounting of the compression rollers 14, 16 according to the present invention, is such that the free frontal side 14*b*, 16*b* of each compression roller 14, 16 extends toward one of the warp beam discs 10 and the two compression rollers 14, 16 overlap by an axial length X in an axially central portion of warp beam 2, whereby length X should be greater than zero, in order to be able to compress the warp threads in every case over the entire axial length of the spool element 8**.

In the particularly advantageous embodiment of the invention illustrated, compression rollers 14, 16 are guided in their respective axial directions independently of each other, e.g., in the direction of the respective double arrow 22, 24. Compression rollers 14, 16 are for this reason rotatably mounted to the ends of respective support arms 26, 28. Each support arm 26, 28 thereby extends in an arrangement that is perpendicular to the rotary axis 18, 20 of the corresponding compression roller 14, 16, toward the warp beam 2 (see particularly FIGS. 1 and 2). Support arms 26, 28 are preferably arranged parallel to each other and can be moved linearly independent of one another in a direction indicated by respective double arrows 22, 24 perpendicular to their longitudinal extension.

Two parallel guide shafts 30 (FIG. 1) are provided for the guiding of each support arm 26, 28 in the illustrated example. Support arms 26, 28, having corresponding guide bores 32 (FIG. 2) slide on guide shafts 30. Support arms 26, 28 can be moved manually and/or may be motor-driven, such as, for example, via threaded spindles 34 which cooperate with corresponding threaded bores 36 of the support arms 26, 28. That is, one rotation of a threaded spindle 34 in the direction of double arrow 38 in FIG. 1 effects the described linear movement of the corresponding support arm 26 or 28 in double arrow direction 22 or 24. A motor or crank E may be used to rotate spindle 34 in direction 38 (see FIG. 1). Note that a second spindle, not shown, is positioned behind spindle 34.

Furthermore, it is especially advantageous if support arms 26, 28 are guided so as to move together linearly in the direction shown by double arrow 12; that is, essentially radial to warp beam 2, which in the illustrated exemplary embodiment of the invention is achieved in that support arms 26, 28 are guided on a common linearly movable sled 40. The means for guiding the sled 40 are not illustrated; these means can take the form of conventional linear guides, for example, such as spherical liners or the like known to those skilled in the art. Such guiding means may include lateral guide rails A, B in FIG. 1. The guiding rails may also be installed between two parallel support walls W as in FIG. 2. Sled 40 can preferably be adjusted pneumatically or hydraulically along with support arms 26, 28 and compression rollers 14, 16, whereby the pneumatic or hydraulic pressure is advantageously adjustable in order to be able to regulate the compression force of the compression rollers 14, 16 by this means. A fluid cylinder C (FIGS. 1 and 2) illustrates an example of means for pneumatic or hydraulic adjustment of the sled 40. The fluid cylinder C is supported by a suitable stationary machine part D on one end and by sled 40 on the other. By actuating fluid cylinder C, sled 40 and compression rollers 14, 16 are moved in direction 12.

Finally, it is effective to form the two compression rollers 14, 16 identically.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A warp machine for warping and spooling warp threads, particularly elastic warp threads, comprising:

(a) a sled having a linear movement axis;

(b) a warp beam including:

(i) a spool element rotatable about an axis; and (ii) first and second lateral, flange-like warp beam end discs; and (c) means disposed between said first and second warp beam end discs for compressing warp threads against said spool element, said means for compressing comprising first and second rotatable compression rollers, each compression roller having a rotary mounting end, a free end, a respective axis, and an axial length dimension, said compression rollers axially overlap each other at a central area of the warp beam by an axial length x, wherein x is equal to or greater than zero, and at least one of said compression rollers is adjustable in an axial direction independent of said other compression roller; and (d) first and second elongated support arms, each joining a respective one of said compression rollers to said sled, each of said support arms having a first end rotatably affixed to a respective compression roller at the mounting end thereof and a second end guided on the sled whereby at least one of the support arms is movable independent of the other in a direction that is perpendicular to their longitudinal extension, wherein the sled is linearly movable in the direction lying essentially radial to the warp beam.

2. The warp machine of claim 1, wherein the compression rollers are rotatably attached to respective support arms whereby each support arm extends toward the warp beam perpendicular to the rotary axis of the corresponding compression roller.

3. The warp machine of claim 2, wherein the support arms are guided so as to be linearly movable independent of each other in a direction that is perpendicular to their longitudinal extension.

4. The warp machine of claim 2, wherein the support arms are adjustable by means of threaded spindles.

5. The warp machine of claim 2, wherein the support arms are guided in common in moving linearly in the direction lying essentially radial to the warp beam.

6. The warp machine of claim 5, wherein the support arms are guided on a common, linearly movable sled, which sled is adjustable.

7. The warp machine of claim 1, wherein the compression rollers are of substantially identical form.

8. The warp machine of claim 2, wherein the support arms are substantially parallel to each other.

9. The warp machine of claim 4, wherein the threaded spindles are manually adjustable.

10. The warp machine of claim 4, wherein the threaded spindles are motor driven.

11. A warp machine for warping and spooling warp threads, particularly elastic warp threads, comprising:

(a) a sled having a linear movement axis;

(b) a warp beam including:

(i) a spool element rotatable about an axis; and (ii) first and second lateral, flange-like warp beam end discs; and (c) means disposed between said first and second warp beam end discs for compressing warp threads against said spool element, mounted so as to be able to move essentially radially relative the warp beam, said means for compressing being formed of at least first and second rotatable compression rollers, each compression roller having a smooth surface and a rotary mounting end, a free end, a respective axis, and an axial length dimension, wherein each of said compression rollers is disposed such that their respective axes are parallel to each other and to the rotary axis of the warp beam, such that the free end of each of the respective compression rollers extends toward a respective one of the first and second warp beam end discs, and such that the compression rollers axially overlap each other at a central area of the warp beam by an axial length x, wherein x is equal to or greater than zero, and at least one of the respective compression rollers is adjustable in an axial direction independent of said at least one other compression roller; and (d) at least first and second elongated support arms, each joining a respective one of said compression rollers to said sled, each of said support arms having a first end rotatably affixed to a respective compression roller at the mounting end thereof and a second end guided on the sled, each support arm extending toward the warp beam perpendicular to the rotary axis of the corresponding compression roller, whereby at least one of the support arms is movable independent of the other in a direction that is perpendicular to their longitudinal extension, wherein the support arms are guided together with said sled, linearly movable in the direction lying essentially radial to the warp beam, said sled being adjustable to regulate the compression force of said compression rollers.

12. The warp machine of claim 11, wherein the support arms are adjustable by means of threaded spindles.

13. The warp machine of claim 11, wherein the compression rollers are of substantially identical form.

14. The warp machine of claim 11, wherein the support arms are substantially parallel to each other.

15. The warp machine of claim 12, wherein the threaded spindles are manually adjustable.

16. The warp machine of claim 12, wherein the threaded spindles are motor driven.

17. A warp machine for warping and spooling warp threads, particularly elastic warp threads, having a warp beam which takes up the warp thread and is mounted so as to rotatable about a rotary axis, comprising a cylindrical spool element with two lateral, flange-like warp beam end discs, and a compression element which is mounted so as to be able to move substantially radially relative to the warp beam, which engages between the warp beam end discs and which presses the warp threads against the spool element, said compression element is formed in two parts from two compression rollers each having smooth surfaces, wherein said compression rollers are each mounted only in the area of one of their frontal sides so as to be rotatable about rotary axes that are parallel to each other and to the rotary axis of the warp beam in such a manner that the free front side of each compression roller extends toward one of the warp beam end discs and the compression rollers overlap each other in an axially central area of the warp beam by an axial length x, wherein $x \geqq$ zero, wherein at least one of the compression rollers is guided so as to be adjustable in its axial direction independent of the other compression roller, wherein each compression roller is rotatably attached to a support arm, whereby each support arm extends toward the warp beam perpendicular to the rotary axis of the corresponding compression roller, and at least one of the support arms is guided so as to be linearly movable independent of the other in a direction that is perpendicular to their longitudinal extension, and wherein the support arms both are guided on a common sled, linearly movable by a fluid cylinder in the direction lying essentially radial to the warp beam, said sled being adjustable by said fluid cylinder, whereby the fluid cylinder pressure is adjustable in order to be able to regulate the compression force of said compression rollers.

18. The warp machine of claim 17, wherein the support arms are adjustable by means of threaded spindles.

19. The warp machine of claim 18, wherein the threaded spindles are manually adjustable.

20. The warp machine of claim 18, wherein the threaded spindles are motor driven.

* * * * *